US011006750B2

(12) United States Patent
Chiu

(10) Patent No.: US 11,006,750 B2
(45) Date of Patent: May 18, 2021

(54) SHELF FRAME FOR A RACK OF SHELVES

(71) Applicant: Wu Hsu Chiu, Changhua County (TW)

(72) Inventor: Wu Hsu Chiu, Changhua County (TW)

( * ) Notice: Subject to any disclaimer, the term of this patent is extended or adjusted under 35 U.S.C. 154(b) by 0 days.

(21) Appl. No.: 16/829,151

(22) Filed: Mar. 25, 2020

(65) Prior Publication Data

US 2020/0329867 A1 Oct. 22, 2020

(30) Foreign Application Priority Data

Apr. 19, 2019 (TW) ..... 108204816

(51) Int. Cl.

| | |
|---|---|
| ***A47B 96/06*** | (2006.01) |
| ***A47B 96/14*** | (2006.01) |
| ***A47B 47/02*** | (2006.01) |
| ***A47B 47/00*** | (2006.01) |

(52) U.S. Cl.

CPC ..... *A47B 96/06* (2013.01); *A47B 47/0083* (2013.01); *A47B 47/021* (2013.01); *A47B 47/028* (2013.01); *A47B 96/063* (2013.01); *A47B 96/1441* (2013.01)

(58) Field of Classification Search

CPC ... A47B 96/06; A47B 96/1441; A47B 47/021; A47B 47/028; A47B 47/0083; A47B 96/063; A47B 47/02; A47B 57/00; A47B 57/06; A47B 57/30; A47B 96/065; A47B 96/067; A47B 96/068; A47B 96/07; A47B 96/14; A47B 47/027

USPC ..... 211/186, 187, 189, 190, 191; 248/214, 248/235, 247, 250; 312/349, 330.1

See application file for complete search history.

(56) References Cited

U.S. PATENT DOCUMENTS

| | | | | | |
|---|---|---|---|---|---|
| 1,411,260 | A * | 4/1922 | Baker | A47B 57/40 | 108/107 |
| 2,510,433 | A * | 6/1950 | Stollenwerk | A47B 57/06 | 248/243 |
| 3,152,698 | A * | 10/1964 | Maddox | A47B 57/30 | 211/126.15 |
| 3,738,726 | A * | 6/1973 | Burst | A47B 79/00 | 312/265.4 |
| 3,862,691 | A * | 1/1975 | Mori | A47B 57/40 | 211/191 |
| 4,040,694 | A * | 8/1977 | Lascarrou | F16B 5/02 | 312/263 |
| 4,491,226 | A * | 1/1985 | Marschak | A47B 45/00 | 108/187 |
| 4,796,541 | A * | 1/1989 | Halstrick | A47B 57/402 | 108/107 |
| 4,821,892 | A * | 4/1989 | Randall | A47B 96/063 | 108/108 |
| 4,915,338 | A * | 4/1990 | Guth | A47B 96/063 | 211/90.01 |

(Continued)

*Primary Examiner* — Jennifer E. Novosad

(57) ABSTRACT

A shelf frame for a rack of shelves includes an elongated body; a ledge extending perpendicularly from a bottom edge of the elongated body, the ledge having a width equal to a height of the elongated body; an elongated enhancement disposed along a top edge of the elongated body, the enhancement being bent toward the ledge; two upright extensions disposed at two ends of the elongated body respectively; and a plurality of fasteners disposed in each of the two upright extensions. The two upright extensions and the elongated body are on the same plane. Each of the two upright extensions has a length equal to twice of the height of the elongated body.

3 Claims, 4 Drawing Sheets

(56) References Cited

U.S. PATENT DOCUMENTS 4,934,642 A * 6/1990 Baron ..... A47B 96/065 108/108
5,020,758 A * 6/1991 Rawlyk ..... A47B 96/063 248/250
5,163,568 A * 11/1992 Laurendeau ..... A47B 96/06 211/187
5,295,591 A * 3/1994 Slater ..... A47B 47/027 211/151
5,330,066 A * 7/1994 Carroll ..... H01M 2/1077 211/189
5,463,966 A * 11/1995 Nilsson ..... F16B 12/34 108/110
5,799,803 A * 9/1998 Muller ..... A47F 5/0043 108/108
5,845,794 A * 12/1998 Highsmith ..... A47B 96/1441 211/189
5,848,711 A * 12/1998 Schmit ..... A47B 95/008 211/90.04
6,070,957 A * 6/2000 Zachrai ..... H02B 1/32 312/265.1
6,920,831 B2 * 7/2005 Lin ..... A47B 57/40 108/107
7,677,514 B1 * 3/2010 Palmer ..... B60K 15/067 248/250
7,757,443 B2 * 7/2010 Ringness ..... E04F 11/025 52/182
8,205,844 B1 * 6/2012 Erickson ..... A47B 96/063 248/222.11
8,672,150 B2 * 3/2014 Chen ..... A47B 57/50 211/187
9,167,896 B1 * 10/2015 Wu ..... A47B 57/40
9,241,566 B1 * 1/2016 Chen ..... A47B 47/0083
9,713,379 B1 * 7/2017 Tsai ..... A47B 47/0083
10,299,594 B2 * 5/2019 Liss ..... A47B 55/00
2004/0238702 A1 * 12/2004 Britten ..... A47B 96/06 248/227.1
2005/0103734 A1 * 5/2005 Saltzberg ..... A47B 96/1441 211/187
2006/0118503 A1 * 6/2006 Patton ..... A47B 95/00 211/187
2009/0090686 A1 * 4/2009 Collins ..... A47B 57/406 211/186
2010/0327135 A1 * 12/2010 Selvidge ..... H05K 7/1489 248/221.11
2012/0000873 A1 * 1/2012 Fitzgerald ..... A47B 96/1441 211/153
2013/0098856 A1 * 4/2013 Troyner ..... A47B 96/1408 211/153
2013/0098857 A1 * 4/2013 Jarvis ..... A47B 47/045 211/182
2015/0282613 A1 * 10/2015 Chen ..... A47B 96/1408 211/187
2015/0342342 A1 * 12/2015 Hu ..... A47B 55/00 211/186
2015/0359330 A1 * 12/2015 Offerman ..... A47B 47/03 211/186
2017/0238702 A1 * 8/2017 Tsai ..... A47B 57/50
2017/0238710 A1 * 8/2017 Tsai ..... A47B 96/14
2017/0280875 A1 * 10/2017 Buckley ..... A47B 47/021
2017/0311721 A1 * 11/2017 Bruckner ..... B65G 1/02
2019/0082835 A1 * 3/2019 Chen ..... H05K 7/1411
2019/0104846 A1 * 4/2019 Chen ..... A47B 88/43
2019/0125077 A1 * 5/2019 Liss ..... A47B 47/0083
2019/0219080 A1 * 7/2019 Schmid-Koemmerling ..... A47B 91/08
2019/0328134 A1 * 10/2019 Walker ..... A47B 57/482

* cited by examiner

SHELF FRAME FOR A RACK OF SHELVES

BACKGROUND OF THE INVENTION

1. Field of the Invention

The invention relates to racks of shelves and more particularly to a shelf frame for a rack of shelves in which in a first mode the shelf frames are mounted on four sides of a shelf of the rack of shelves and are capable of decreasing the possibilities of articles falling, and in a second mode the shelves are easy to hold into position or the articles are easy to place on the shelf.

2. Description of Related Art

Adjustable racks of shelves are widely used in stores due to their easy assembly and sufficient structural strength. Further, a height of the rack of shelves can be easily adjusted based on applications. A shelf is mounted on four shelf frames prior to placing articles thereon.

However, shelves may not be accommodated to mount on the shelf rack. Thus, cutting of the shelves is required. Further, the shelves may slide in assembly. Furthermore, articles placed on the shelves may fall and be damaged if sufficient care is not taken.

Thus, the need for improvement still exists.

SUMMARY OF THE INVENTION

It is therefore one object of the invention to provide a shelf frame for a rack of shelves, including an elongated body; a ledge sticking inward from the elongated body and being perpendicular to the elongated body, the ledge having a width equal to that of the elongated body; an elongated enhancement disposed along an edge of the elongated body and being distal from the ledge, the enhancement being bent toward the ledge; two upright extensions disposed at two ends of the elongated body respectively; and a plurality of fasteners disposed at the extensions opposite to the ledge; wherein the extensions and the elongated body are on the same plane and are parallel to each other; and wherein the extension has a length equal to twice of the width of the elongated body.

Preferably, in a first mode of mounting the shelf frames on the rack of shelves, the extensions are downward mounted on the rack of shelves. A shelf is mounted on the ledges and the elongated body serves a raised limit member. Thus, the shelf is prevented from projecting out of the rack of shelves due to vibration. Further, articles placed on the shelf are prevented from falling.

Preferably, in a second mode of mounting the shelf frames on the rack of shelves, the extensions are upward mounted on the rack of shelves. A shelf is mounted on the shelf frames and articles can be placed on the shelf. The ledge has a width equal to that of the elongated body and the extension has a length equal to twice of the width of the elongated body. A user may mount the shelf frames in a mixed mode depending on applications. A shelf is mounted on the ledges and there is no significant height difference between the shelf and the ledges.

The enhancement can increase the structural strength of the elongated body and prevent the hand of a user holding the shelf frame from being hurt.

The above and other objects, features and advantages of the invention will become apparent from the following detailed description taken with the accompanying drawings.

DETAILED DESCRIPTION OF THE INVENTION

Figure 1:
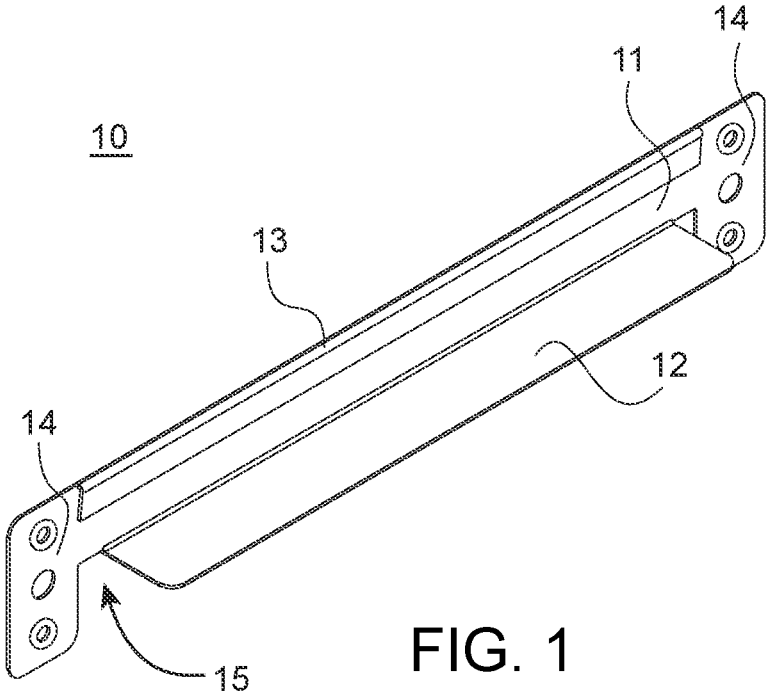
FIG. 1 is a perspective view of a shelf frame for a rack of shelves according to the invention.

Referring to FIG. 1, a shelf frame 10 for a rack of shelves in accordance with the invention comprises an elongated body 11, a ledge 12 extending perpendicular from a bottom edge of the elongated body 11, the ledge 12 having a width equal to the height of the elongated body 11, an elongated enhancement 13 extending along a top edge of the elongated body 11 and being distal from the ledge 12, the enhancement 13 being bent toward the ledge 12, two upright extensions 14, extending from each of two ends of the elongated body 11 respectively, and two cuts 15, each cut disposed between an end of the ledge 12 and the respective extension 14. Each corner of the ledge 12 and the extension 14 is curved for the purpose of preventing the hand of a user holding the shelf frame 10 from being hurt.

The ledge 12 has a width equal to the height of the elongated body 11 and the extension 14 has a length equal to twice of the height of the elongated body 11. For the rack having the same height, regarding the shelf frame 10, a horizontal height of the ledge 12 is irrespective of downward assembly of the extensions 14, upward assembly of the extensions 14, or a combination thereof. In other words, the extensions 14 and the elongated body 11 of any shelf of the rack are on the same vertical plane.

Figure 2:
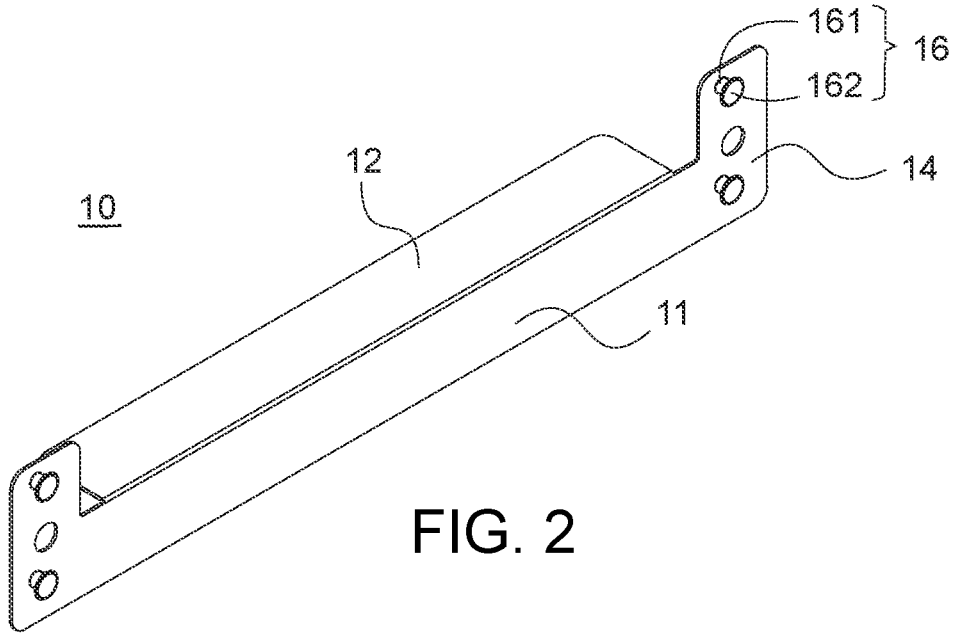
FIG. 2 is another perspective view of the shelf frame.

Referring to FIG. 2, the extensions 14 and the elongated body 11 are on the same vertical plane. A plurality of fasteners 16 are provided at the extensions 14. The fastener 16 includes a neck 161 and a head 162 having a diameter greater than that of the neck 161.

Figure 3:
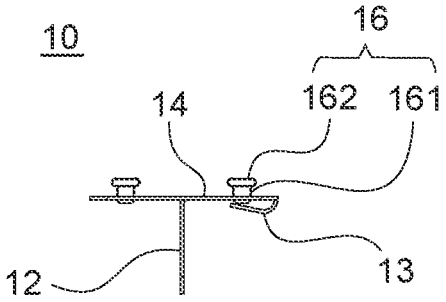
FIG. 3 is a side elevation of the shelf frame.
Figure 4:
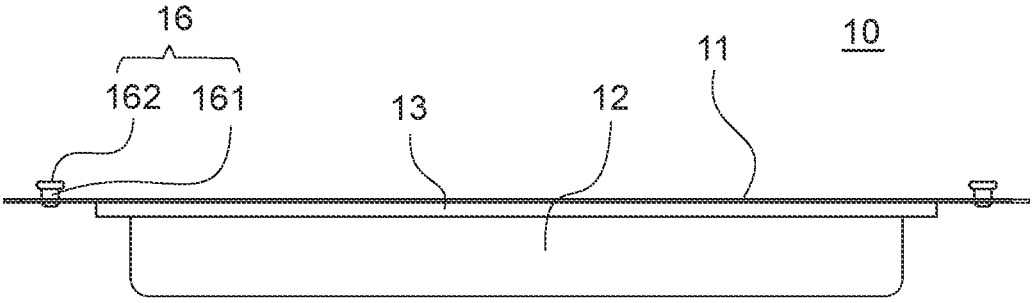
FIG. 4 is a top view of the shelf frame.

Referring to FIGS. 3 and 4, the enhancement 13 has a predetermined thickness after being bent. Thus, the enhancement 13 can increase the structural strength of the elongated body 11 for support.

Figure 5:
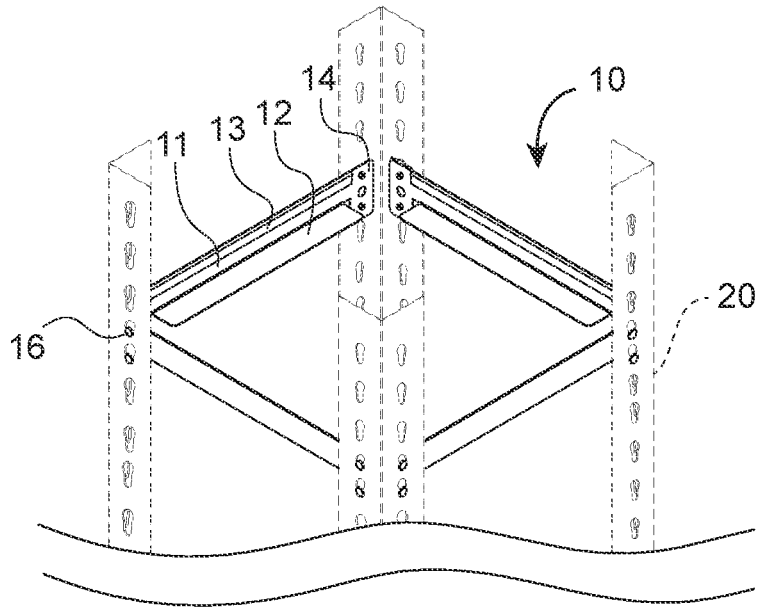
FIG. 5 is a perspective view of the four shelf frames mounted on a shelf of a rack of shelves in a first preferred embodiment.

Referring to FIG. 5, in a first preferred embodiment a rack of shelves having four posts 20 are shown in which the ledge 12 of each of the four shelf frames 10 is mounted on a bottom of the shelf frame 10, and a top of the elongated body 11 has an elevation greater than that of the ledge 12 so that the elongated body 11 can serve as a raised limit member.

Figure 6:
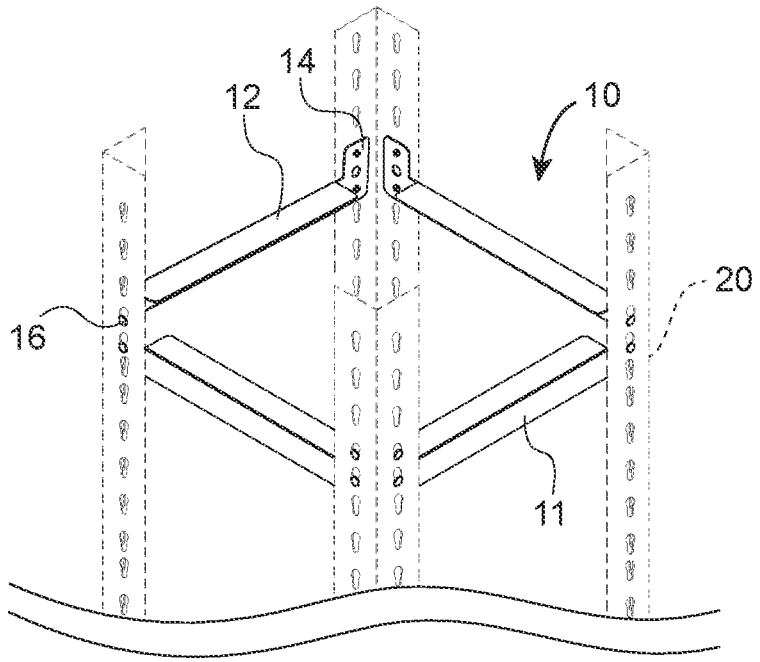
FIG. 6 is a perspective view of the four shelf frames mounted on a shelf of a rack of shelves in a second preferred embodiment.

Referring to FIG. 6, in a second preferred embodiment a rack of shelves having four posts 20 are shown in which the ledge 12 of each of the four shelf frames 10 is mounted on a top of the shelf frame 10, and a top of the elongated body 11 has an elevation equal to that of the ledge 12. Thus, the elongated body 11 cannot serve as a raised limit member.

Figure 7:
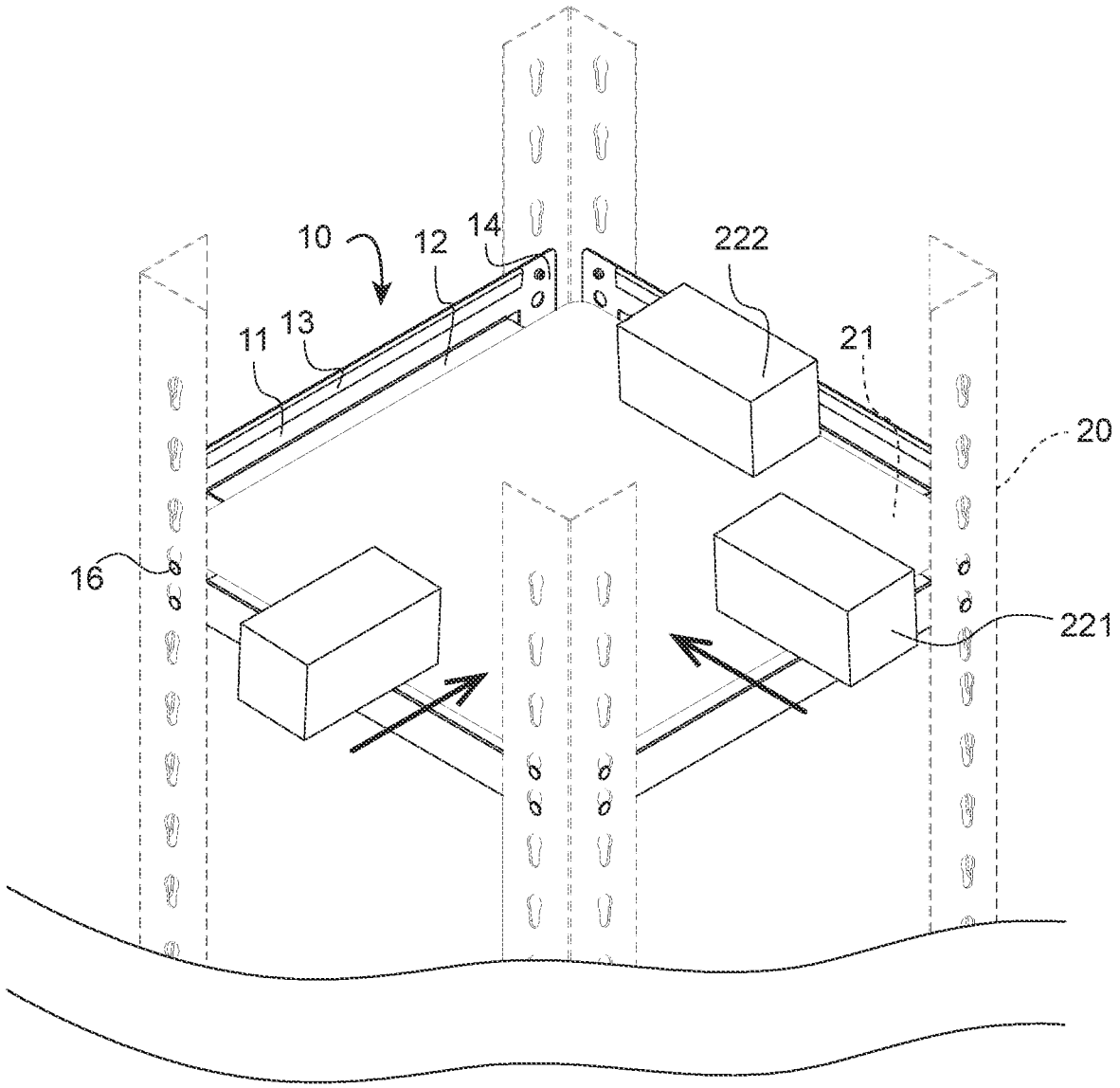
FIG. 7 is a perspective view of the four shelf frames mounted on a shelf of a rack of shelves in a third preferred embodiment.

Referring to FIG. 7 in conjunction with FIG. 3, in a third preferred embodiment a rack of shelves having four posts 20 are shown in which the shelf frames 10 are mounted on the rack of shelves in a mixed mode. In detail, the extensions 14 of two shelf frames 10 are downward mounted on the rack of shelves, and the extensions 14 of the other two shelf frames 10 are upward mounted on the rack of shelves. The fasteners 16 are used to secure the shelf frames 10 to the posts 20. The ledge 12 has a width equal to the height of the elongated body 11 and the extension 14 has a length equal to twice of the height of the elongated body 11. Thus, the extensions 14 and the elongated body 11 of any shelf of the rack are on the same vertical plane. A shelf 21 is mounted on the ledges 12 and there is no significant height difference between the shelf 21 and the ledges 12. A plurality of articles 221 are placed on the shelf 21. It is possible to push the articles 221 through the shelf frames 10 because the shelf frames 10 do not serve as a limit member. This has the advantage of being able to place the articles 221 on the shelf 21 or pushing the articles 221 on the shelf 21. Another article 222 is also shown placed on the shelf 21 and is limited by both the elongated body 11 and the enhancement 13. Thus, the article 222 is prevented from falling. It is envisaged by the invention that a user may mount the shelf frames 10 in the mixed mode depending on a desired application.

While the invention has been described in terms of preferred embodiments, those skilled in the art will recognize that the invention can be practiced with modifications within the spirit and scope of the appended claims.

What is claimed is:

1. A shelf frame for a rack of shelves, comprising:

an elongated body;

a ledge extending perpendicular from a bottom edge of the elongated body, the ledge having a width equal to a height of the elongated body;

an elongated enhancement disposed along a top edge of the elongated body and being distal from the ledge, the elongated enhancement bent toward the ledge;

two upright extensions disposed at two ends of the elongated body respectively; and a plurality of fasteners disposed in each of the two upright extensions, wherein each of the plurality of fasteners includes a neck and a head, the head having a diameter greater than that of the neck;

wherein the two upright extensions and the elongated body are on the same plane, and wherein each of the two upright extensions has a length equal to twice of the height of the elongated body.

2. The shelf frame for a rack of shelves of claim 1, further comprising two cuts, each cut disposed between an end of the ledge and one of the two the upright extensions, respectively.

3. The shelf frame for a rack of shelves of claim 1, wherein the ledge and the two upright extensions each have curved corner edges.

* * * * *